United States Patent [19]

Tsumura

[11] 4,108,741

[45] Aug. 22, 1978

[54] PROCESS FOR PRODUCTION OF ALUMINUM

[75] Inventor: Yoshishige Tsumura, Tokyo, Japan

[73] Assignee: Mitsui Aluminum Co., Ltd., Tokyo, Japan

[21] Appl. No.: 798,457

[22] Filed: May 19, 1977

[30] Foreign Application Priority Data

May 26, 1976 [JP] Japan ..... 51-59953

[51] Int. Cl.[2] ..... C25C 3/06

[52] U.S. Cl. ..... 204/67

[58] Field of Search ..... 204/67

[56] References Cited

U.S. PATENT DOCUMENTS 2,373,320 4/1945 Lovell et al. ..... 204/67

3,501,387 3/1970 Love ..... 204/67

3,761,365 9/1973 Haupin et al. ..... 204/67

*Primary Examiner*—John H. Mack

*Assistant Examiner*—H. A. Feeley

*Attorney, Agent, or Firm*—Oblon, Fisher, Spivak, McClelland & Maier

[57] ABSTRACT

Disclosed herein is a process for producing aluminum of high purity by the steps of electrolyzing an electrolytic bath composed preponderantly of aluminum chloride or aluminum bromide for thereby educing aluminum on the cathode, causing the cathodic product of electrolysis to precipitate to the bottom of the electrolytic cell, then melting the precipitate to produce molten aluminum, casting the molten aluminum into ingots and cooling the ingots.

6 Claims, 1 Drawing Figure

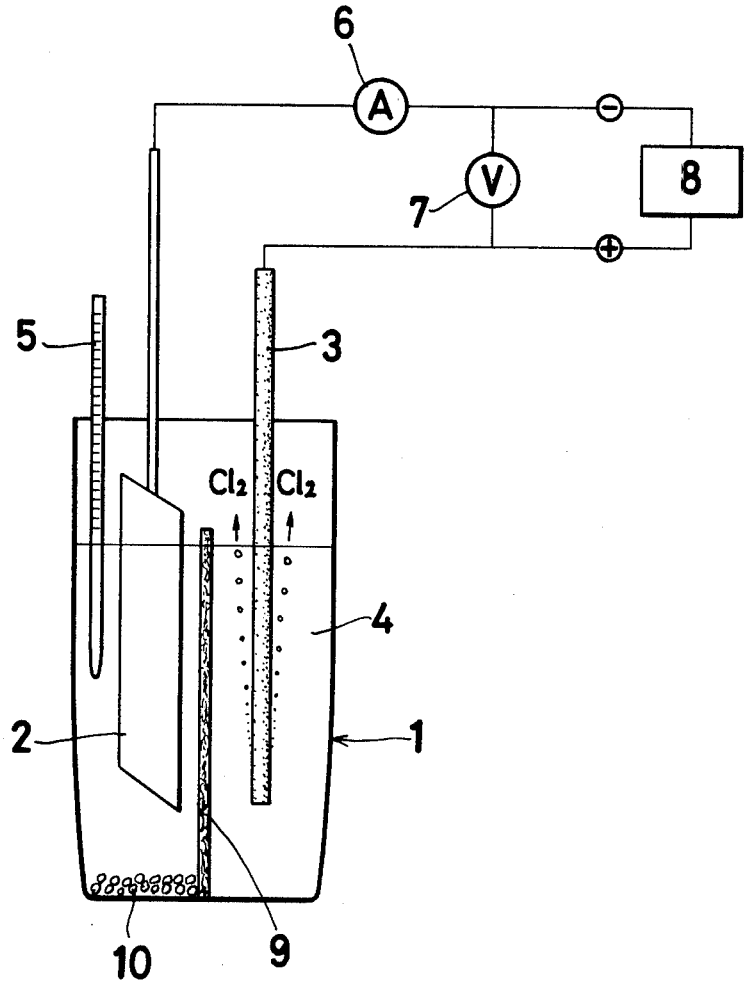
6
A
V
7
8
5
3
Cl2
Cl2
4
2
1
10
9

PROCESS FOR PRODUCTION OF ALUMINUM

BACKGROUND OF THE INVENTION

This invention relates to a process for the low-temperature electrolysis of aluminum, which produces aluminum by electrolysis of aluminum chloride or aluminum bromide.

The electrolytic process for aluminum refining which electrolyzes a bath composed preponderantly of aluminum chloride or aluminum bromide and consequently educes metallic aluminum at the cathode enjoys advantages in that the electrolysis is effectively performed at low temperatures of from 120° to 250° C, the operation is easy, the electrolytic cell is simple in structure, the electric potential applied to the electrolytic bath is low and the current efficiency is high. Nevertheless this process has a disadvantage that electric deposition of aluminum on a cathode plate does not satisfactorily proceed. Because of the disadvantage, this process has so far failed to find utility in practical applications.

Concerning a method whereby molten aluminum is obtained by electrolyzing a molten salt containing aluminum chloride at temperatures higher than the melting point of aluminum (660° C), there have been reported quite a number of studies including a study covering Alcoa Smelting Process ("A Revolutionary Alcoa Process," Business Week, January 20 (1973), J. D. Harper: Eng. Min. J., 174, No. 2 (1973), 30). In contrast, as to a method whereby said electrolysis is effected at temperatures below the melting point of aluminum, there have been reported a relatively small number of studies including Plotnikow et al: Z. Electrochem., 37 (1931), 83, Engelhardt: Handb. Techn. Electrochem., 3 (1934), 384, Czochralski, Mikolajczyk: Wiadomosci. Inst. Metallurg., 2, (1935) 31 and Midorikawa et al: Electrochem., 24 (1956) 562.

Rinzo Midorikawa developed a technique for improving the electric deposition of aluminum on the cathode plate by adding lead chloride to the electrolytic bath (Electrochem., 24 (1956) 562, Japan). However, even when the Midorikawa method is carried out under the most favorable conditions, the current density used in the formation of the electrically deposited layer cannot be raised above 0.5 A/dm$^2$ and the thickness of the resulting layer is about 0.1 mm at most so that this technique has not been reduced to commercial application.

An object of the present invention is to provide an improvement in a process for the production of aluminum by electrolyzing a bath composed preponderantly of aluminum chloride and/or aluminum bromide for thereby causing electric deposition of aluminum on the cathode plate, which improvement permits production of aluminum of high purity without reference to the nature of the electrically deposited layer.

BRIEF SUMMARY OF THE INVENTION

To accomplish the object described above according to this invention, there is provided a process for the production of aluminum of high purity by electrolyzing an electrolytic bath containing at least one member selected from the group consisting of aluminum chloride and aluminum bromide and thereby educing aluminum on the cathode, forcibly or naturally separating the educed aluminum and causing the separated aluminum to precipitate to the bottom of the electrolytic bath to give rise to a precipitate composed preponderantly of aluminum, melting the precipitate and thereby giving rise to a phase of aluminum of high purity and isolating this phase of aluminum.

The aluminum educed on the cathode grows in the shape of dendrites and, if left to continue such growth, has a possibility of forming a short-circuit between the cathode and the anode. This invention, therefore, also embraces a technique for precluding this phenomenon by having a magnesium salt or calcium salt incorporated in the electrolytic bath.

BRIEF DESCRIPTION OF THE DRAWING

The drawing is a schematic diagram illustrating an electrolytic cell used in Example 1.

DETAILED DESCRIPTION OF THE INVENTION

This invention relates to an improvement in and concerning a process for the production of aluminum by the electrolysis of a bath composed preponderantly of aluminum chloride and/or aluminum bromide. To be specific, the present invention produces metallic aluminum of high purity by the steps of electrolyzing at a high current density a bath composed preponderantly of aluminum chloride and/or aluminum bromide for thereby educing aluminum on the cathode, forcibly causing or naturaly allowing the educed aluminum to be separated from the cathode plate and precipitated to the bottom of the electrolytic cell to give rise to a precipitate composed preponderantly of aluminum and thereafter melting the precipitate.

The present invention enables aluminum of high purity to be continuously produced without reference to the condition of aluminum being educed on the anode, rendering the aforementioned low-temperature electrolysis of aluminum commercially feasible.

The bath for the present invention is composed preponderantly of aluminum chloride and/or aluminum bromide. In the case of a bath composition involving aluminum chloride, potassium chloride and sodium chloride, the ternary eutectic composition is made up of 76.3% of aluminum chloride, 9.2% of potassium chloride and 14.5% of sodium chloride. In the case of a bath composition having aluminum bromide as its principal component, the eutectic composition of aluminum bromide and potassium chloride at 100° C is 88 to 93% of aluminum bromide and 12 to 7% of potassium chloride.

For practical purpose of the present invention, the electrolytic bath is required to have an aluminum chloride and/or aluminum bromide content of at least 50% by weight. If the content is lower than 50% by weight, then the melting point of the bath exceeds 200° C. As to the percentage composition of other components of the electrolytic bath, sodium chloride is required to account for from 10 to 40% by weight and potassium chloride for from 0 to 36% by weight. The percentage composition described above is critical because, as is evident from the ternary phase diagram of aluminum chloride, sodium chloride and potassium chloride, the three components are required to fall in the specified ranges in order for the melting point of the mixed bath to fall below 200° C. Particularly, the sodium chloride content within the specified range has an effect of improving the electric conductivity of the bath. The substances which the bath is not allowed to contain are those defiling substances such as, for example, chlorides of iron, silicon and copper which have adverse effects upon the quality of aluminum metal.

For actual use, the bath composition is suitably determined by considering all these factors. Preferably the bath composition is from 60 to 87% of aluminum chloride, from 14 to 30% of sodium chloride and from 5 to 10% of potassium chloride respectively by weight.

Although the velocity of the eduction of aluminum increases in proportion to the magnitude of current density, the current density increases with the increasing cell voltage and the decreasing current efficiency. The current density for the actual electrolysis, therefore, is chiefly chosen from the practical point of view. The lower limit of the current density for the cathode is 0.5 $A/dm^2$. If the current density is very low, then problems tend to occur with respect to the separation and precipitation of aluminum educed and electrically deposited on the cathode and the rate of the formation of aluminum is itself lowered to the point where the process is deprived of its commercial feasibility. From the economic point of view and in consideration of operational factors such as voltage efficiency, bus bar temperature and cell temperature, the upper limit of the current density is fixed at 200 $A/dm^2$.

For the similar reasons, the upper and lower limits of the current density for the anode are fixed at 0.5 $A/dm^2$ and 200 $A/dm^2$ respectively and those of the cell voltage are fixed at 11.4 V and 2.7 V (on the assumption that the interelectrode gap is 5 mm) respectively. It should be noted that said limits of the cell voltage are automatically determined in accordance with said limits of current density.

Correspondingly to said limits of current density and cell voltage, the limits of the temperature of the electrolytic bath are fixed at 120° C and 250° C.

Since the electrolysis is carried out at these low temperatures, the electrolytic cell need not be made of a special anticorrosive material. A cell made of ordinary glass can advantageously be used for the electrolysis.

In the electrolysis, there can be used any of the known anodes made of substances low in electrical resistance such as, for example, silicon carbide and tungsten and other similar metals. Specifically, use of an anode of tungsten plate proves most advantageous because of the low electric resistance of tungsten.

As to the cathode, there can be used any of the cathodes made of plates of aluminum and other metals. For actual purpose, however, use of the anode of aluminum plate proves particularly desirable from the standpoint of prevention of the produced aluminum from adulteration by other metals.

The purity of the aluminum educed on the cathode by electrolysis is affected by the bath composition. If the bath happens to contain compounds of iron, silicon, copper, etc., for example, these elements are educed from the bath before aluminum because they have lower decomposition voltages than aluminum.

When the anode and cathode are parallelly opposed to each other across a gap, the opposition may be either in the vertical direction or in the horizontal direction. With due consideration to the case with which the educed aluminum is precipitated, however, the opposition in the horizontal direction is more advantageous than in the vertical direction.

Passage of an electric current between the cathode and anode disposed as described above in the electrolytic cell causes electrolysis of the electrolytic bath, with the result that aluminum is educed on the cathode and chlorine and/or bromine generated at the anode.

With lapse of time, the aluminum educed in the shape of dendrites on the cathode gradually gain in size. When the growth reaches a depth of about 4 mm, for example, the aluminum of the shape of dendrites expands enough to form a short-circuit with the anode and entail degradation of current efficiency, although the deposited aluminum may at times fall spontaneously off the cathode.

For the prevention of the formation of said short-circuit, a pump may be used to circulate the electrolytic bath and impart shocks to the deposited aluminum or some suitable mechanical means may be employed to impart a shaking motion or raking motion to the deposited aluminum.

The educt (mostly of aluminum) which has precipitated from the cathode has a greater density than the electrolytic bath and, therefore, collects in the bottom of the electrolytic cell and forms what appears to be a mass of sponge. Where the electrolytic bath is circulated by a pump for the purpose mentioned above, the educt is recovered by filtration through a fabric made of glass fiber. This spongy deposit contains from 30 to 60% by weight of aluminum, with the balance consisting of the electrolytic bath and aluminum oxide resulting from the reaction involving the water present in the electrolytic bath. Aluminum of high purity can be obtained by melting this spongy deposit into an aluminum phase and a fusion slag phase composed of the other components and isolating the former phase from the latter. The aluminum thus isolated has a purity in the range of from 99.0 to 99.9%. If the electrolytic bath in use is of a type free from the compounds of iron, silicon, copper, etc., the purity of the isolated aluminum can be raised to the range of from 99.3 to 99.9%.

The melting of this spongy deposit is accomplished by a method using flux or a method resorting to application of heat. The former method comprises the steps of mixing the educt into sodium chloride, potassium chloride or a fluoride retained in a fused state and consequently giving rise to a molten flux phase and an aluminum phase and subsequently isolating the aluminum phase from the other phase. The latter method comprises heating and melting the educt in an autoclave to give birth to a fused aluminum phase and a slag phase and isolating aluminum. By either of these methods, there is obtained aluminum having a purity exceeding 99.3% by weight.

This invention also embraces the outcome of an additional study made in search of a method capable of preventing said growth of the aluminum educed on the cathode in the shape of dendrites. The outcome of this study is the discovery that the growth of the educed aluminum can be curbed effectively without bringing about any adverse effect on the purity of educed aluminum when the electrolytic bath in use incorporates therein from 0.1 to 3% by weight of a magnesium or calcium salt having a higher decomposition voltage than aluminum.

Preferable magnesium salt and calcium salt for the purpose are magnesium chloride and calcium chloride. This is because carbonates, sulfates and other salts of magnesium and calcium react with the aluminum educed in the shape of dendrites and oxidize them to the extent of significantly degrading the electrolytic efficiency,, whereas magnesium chloride or calcium chloride incorporated in said small proportion brings about no such adverse effect other than a negligibly small degradation of the bath's melting point.

With the progress of electrolysis, the concentration of the electrolytic bath gradually changes and the aluminum chloride and/or aluminum bromide content in the bath decreases. By gradual replenishment of aluminum chloride and/or aluminum bromide, however, the continuous operation of the present process can be ensured.

The electric energy which is required for melting the spongy mass of aluminum precipitated in the bottom of the electrolytic cell is about 540 KWH per ton. Heavy oil or some other inexpensive thermal energy may be used for the fusion of said aluminum deposit.

In short, the present invention, in the electrolysis of aluminum chloride or aluminum bromide, does not contemplate directly obtaining as its final product the aluminum educed on the cathode but aims to offer as the final product the aluminum obtained by causing the educed aluminum to precipitate to the bottom of the electrolytic cell and subsequently melting the precipitated aluminum. The improved process enables the electrolysis to be carried out at a high current density, rendering the operation commercially feasible.

Now, the present invention will described with reference to working examples.

EXAMPLE 1

(Electrolytic cell) — In a constant temperature bath filled with silicone oil and provided with an agitation device, there was disposed an electrolytic system such as that illustrated in the accompanying drawing.

In the drawing, 1 denotes a glass beaker 300 cc in inner volume, 2 a cathode of aluminum plate 1 mm in thickness, 30 mm in width and 60 mm in length, 3 an anode formed of three silicon carbide rods 7.4 mm in diameter and 150 mm in length, 4 an electrolytic bath weighing 500 g and composed of 76.3% by weight of $AlCl_3$, 9.2% by weight of KCl and 14.5% by weight of NaCl, 5 a mercury thermometer, 6 an ammeter, 7 a voltmeter, 8 a rectifier, and 9 a diaphragm made of glass fiber.

Denoted by 10 is a spongy mass of aluminum formed by the electrolysis and subsequently precipitated to the bottom of the electrolytic cell.

(Temperature of the electrolytic bath) — The electrolytic bath was maintained at 150° C.

The constant temperature bath was maintained at 134° C, because internal heating occurred during the electrolysis to elevate the temperature of the constant temperature bath by 16° C.

(Current density) — The electric current was passed at a fixed amperage of 15 A.

Since the area of immersion of the cathode in electrolytic bath was 3 cm × 5 cm, the current density for the cathode was 100 A/dm$^2$. The anode was immersed to a depth of 5 cm in the electrolytic bath. Thus, the area of immersion was $0.74\pi \times 5 \times 3$ cm$^2$ and the current density for the anode was 43 A/dm$^2$.

The gap between the cathode and anode was fixed at 10 mm. In this case, the voltage was 8.2 to 9.5 V.

(Results) — The electrolysis was carried out for three hours. At intervals of 10 minutes during the electrolysis, the spongy deposit of aluminum educed on the cathode of aluminum plate was scratched off with a glass rod and allowed to settle to the bottom of the electrolytic cell.

At the anode, chloride gas having a purity of about 70% was produced.

At the end of the electrolysis, the beaker was tilted to decant most of the electrolytic bath. The spongy deposit of aluminum remaining in the bottom was separated. It weighed 27 g and was found by analysis to be composed of 45% by weight of aluminum and the balance mostly of the electrolytic bath. In appearance, this was a gray sludge-like substance. This mixture was thrown into a flux which was a molten composition made up of 45% of sodium chloride, 45% of potassium chloride and 10% of sodium fluoride. In the flux, the mixture was fused to separate off an aluminum phase. By isolating and cooling this aluminum phase, granular aluminum of high purity was obtained. Thus was produced 12.15 g of aluminum having a purity of 99.3%. Since the theoretical amount of electricity required for electrolytic separation of 1 g of aluminum is 3 AH, the current efficiency in the present example is calculated to be 81%.

EXAMPLE 2

In an electrolytic system of a construction illustrated in the accompanying drawing, an aluminum plate 10 mm in thickness, 30 mm in width and 60 mm in length was used as a cathode. In this system, electrolysis was carried out under the same conditions identical to those of Example 1. The educed aluminum was processed in entirely the same manner.

The current density for the cathode was 100 A/dm$^2$, the current density for the anode was 100 A/dm$^2$, the bath temperature was 150° C and the bath voltage was 2.7 V.

The electrolysis produced 12.75 g of granular aluminum having a purity of 99.9%, with the current efficiency at 85%.

In this electrolysis, the chlorine generated at the anode reacted with the aluminum of the cathode to produce aluminum chloride and pass into the electrolytic bath. Thus, no chlorine gas was issued.

What is claimed is:

1. A process for the production of aluminum, which comprises the steps of introducing into an electrolytic cell an electrolytic bath containing 50 to 93% by weight of aluminum chloride and additionally incorporating therein 0.1 to 3% by weight, based on the weight of the bath, of at least one member selected from the group consisting of magnesium salts and calcium salts; electrolyzing said electrolytic bath under conditions of a current density for the anode in the range of from 0.5 A/dm$^2$ to 200 A/dm$^2$, a current density for the cathode in the range of from 0.5 A/dm$^2$ to 200 A/dm$^2$, a bath temperature in the range of from 120° C to 250° C and a cell voltage in the range of from 2.7 V to 11.4 V, thereby educing aluminum on the cathode; causing the educed aluminum to come off the cathode and form a precipitate in said electrolytic bath; separating said precipitate from said electrolytic bath; melting said separated precipitate to give rise to an aluminum phase and a fusion slag phase; and isolating said aluminum phase.

2. The process according to claim 1, wherein said electrolytic bath is composed of 10 to 40% by weight of sodium chloride, 0 to 36% by weight of potassium chloride, and more than 50% by weight of aluminum chloride.

3. The process according to claim 1, wherein said electrolytic bath is composed of 60 to 87% by weight of aluminum chloride, 14 to 30% by weight of sodium chloride and 5 to 10% by weight of potassium chloride.

4. The process according to claim 1, wherein the anode is made of metallic aluminum having a purity of not less than 99%.

5. The process of claim 1, wherein the anode is formed of one member selected from the group consisting of tungsten and silicon carbide and the cathode is formed of aluminum.

6. The process of claim 1, wherein said magnesium salts and calcium salts are magnesium chloride and calcium chloride.

* * * * *